US008610350B2

(12) United States Patent
Lankes et al.

(10) Patent No.: US 8,610,350 B2
(45) Date of Patent: Dec. 17, 2013

(54) ELECTRODE STRUCTURES FOR DISCHARGE LAMPS

(75) Inventors: Simon Lankes, Falkensee (DE); Alan L. Lenef, Belmont, MA (US)

(73) Assignee: OSRAM Gesellschaft mit Beschraenkter Haftung, Munich (DE)

( * ) Notice: Subject to any disclaimer, the term of this patent is extended or adjusted under 35 U.S.C. 154(b) by 104 days.

(21) Appl. No.: 12/637,861

(22) Filed: Dec. 15, 2009

(65) Prior Publication Data

US 2011/0140601 A1 Jun. 16, 2011

(51) Int. Cl.
*H01J 61/06* (2006.01)
*H01J 9/02* (2006.01)

(52) U.S. Cl.
USPC ..... 313/631; 313/632

(58) Field of Classification Search
USPC ..... 313/631, 623–625, 634–636, 493, 313/318.12, 570, 578; 118/26, 27, 35
See application file for complete search history.

(56) References Cited

U.S. PATENT DOCUMENTS

| | | | | |
|---|---|---|---|---|
| 2,177,703 | A | 10/1939 | Francis | |
| 2,306,925 | A | 12/1942 | Aicher | |
| 2,744,703 | A | 5/1956 | Sessions | |
| 3,303,377 | A | 2/1967 | Jansen et al. | |
| 4,506,187 | A * | 3/1985 | Hofmann et al. | 313/341 |
| 4,893,057 | A * | 1/1990 | Tillman nee Caruso et al. | 313/631 |
| 5,856,726 | A | 1/1999 | Evans et al. | |
| 5,883,468 | A * | 3/1999 | Hobbs et al. | 313/579 |
| 6,121,729 | A * | 9/2000 | Takao et al. | 313/631 |
| 6,437,509 | B1 | 8/2002 | Eggers | |
| 7,176,632 | B2 | 2/2007 | Lenef et al. | |
| 7,541,726 | B2 | 6/2009 | Li et al. | |
| 7,705,538 | B2 | 4/2010 | Grundmann et al. | |
| 2005/0206326 | A1 * | 9/2005 | Suzuki et al. | 315/246 |
| 2007/0108911 | A1 | 5/2007 | Hasegawa et al. | |

FOREIGN PATENT DOCUMENTS

| | | | |
|---|---|---|---|
| DE | 3305468 | A1 | 8/1984 |
| DE | 102004057906 | A1 | 6/2006 |
| EP | 1763065 | A2 | 3/2007 |
| JP | 6267502 | A | 9/1994 |

OTHER PUBLICATIONS

English abstract of DE 3305468 A1.
English abstract of JP 6267502 A.
English abstract of DE 3305468 A1 Aug. 23, 1984.
English abstract of JP 6267502 A Sep. 22, 1994 .
European Search Report of EP 10 19 0701 dated Mar. 10, 2011.

* cited by examiner

*Primary Examiner* — Anh Mai
*Assistant Examiner* — Elmito Breval

(57) ABSTRACT

An electrode structure configured to operate in a discharge lamp and a method to make such an electrode structure are described. The electrode structure includes an electrode head portion comprising a plurality of raised features arranged in a configuration such that an average pitch of the plurality of raised features is at least 105%. The method includes providing an electrode configured to operate in the discharge lamp and forming raised features on an electrode head portion of the electrode at an average pitch of at least 105%.

15 Claims, 3 Drawing Sheets

ELECTRODE STRUCTURES FOR DISCHARGE LAMPS

BACKGROUND

The present invention relates generally to electrode structures for discharge lamps.

Electrodes in short-arc discharge lamps typically operate in a high-temperature environment. Reducing the operating temperature of the electrodes is desirable in order to reduce degradation from evaporation and extend the lifetime of the lamp. The electrode operating temperature is determined by the electrical power input, which heats electrodes, and Planck's radiation law (i.e., the electro-magnetic emission of an electrode, which results in the electrode cooling). Thus, increasing the emissivity of an electrode structure will increase the heat dissipation of the electrode.

Because electrodes are routinely operated near the melting point of the electrode material (e.g., tungsten), the emissivity of an electrode structure is important parameter in discharge lamp design. For example, high-power DC lamps used in microlithography include massive anodes that are coated or microstructured to increase emissivity. Such anodes are expensive and not practical in lower-power, short-arc lamps. This technique also has the drawback that neither the coating or microstructure can be applied as close to a front portion of an electrode as desired because a non-tungsten coating will either melt or sublimate at temperatures approaching the tungsten melting point. Moreover, re-crystallization and surface diffusion will destroy tungsten microstructures over time.

Massive anodes are also not practical in some lamps because electrode size restrictions of many discharge lamps. That is, many discharge lamps are designed to accommodate only electrodes with small diameters or widths. Thus it is not always possible to reduce the electrode operating temperature at a given electrical power input by greatly increasing the size of an electrode.

FIG. 1 shows a conventional electrode structure for use in a ultra-high-pressure mercury lamp. Coil 102 is tightly wound around the electrode shaft portion 104 in one or more layers to form electrode head portion 106. Front portion 108 is condensed by over-melting the ends of coil 102. The electrode temperature is determined by the size of electrode 100, which in turn is determined by the length of coil 102, the number of coiled layers, and the diameter (or width) of the wires of coil 102.

FIG. 2 shows another conventional electrode structure for use in a ultra-high-pressure mercury lamp. Coil 202 is tightly wound around electrode head portion 204. Head portion 204, front portion 206, and shaft portion 208 are formed by shaping a conventional massive electrode material such as tungsten with conventional machining techniques such as lathing or grinding. Electrode 200 has better emissivity than electrode 100 because of the shape of front portion 206 and coil 202 is wrapped around electrode head portion 204, electrode head portion 204 being massive and can effectively conduct the heat generated in the front portion 206 to coil 202.

As noted above, however, the amount an electrode size may be increased is limited in many applications for practical and/or commercial reasons.

SUMMARY

Embodiments provide apparatuses and methods for reducing the electrode operating temperature without increasing the size of the electrode and without adding significant costs to the electrode manufacturing process.

Embodiments include electrode structures that may be implemented in a discharge lamp. Embodiments include electrode structures that may be implemented in AC and/or DC discharge lamps.

Some embodiments include an electrode structure configured to operate in a discharge lamp, the electrode structure including an electrode head portion and a coil, wherein the coil is wrapped around the electrode head portion at an average pitch of at least 105%.

Some embodiments include an electrode structure configured to operate in a discharge lamp, the electrode structure comprising an electrode head portion comprising a plurality of raised features arranged in a configuration such that an average pitch of the plurality of raised features is at least 105%.

Some embodiments include a discharge lamp including two electrode structures, wherein at least one of the two electrode structure includes an electrode head portion and a coil. The coil is wrapped around the electrode head portion at an average pitch of at least 105%.

Some embodiments include a method of manufacturing an electrode structure for a discharge lamp. The method includes providing an electrode configured to operate in the discharge lamp and forming raised features on an electrode head portion of the electrode at an average pitch of at least 105%.

These and other features of the invention will be better understood when taken in view of the following drawings and a detailed description.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

The following detailed description refers to the accompanying drawings that show, by way of illustration, specific details and embodiments in which the invention may be practiced. These embodiments are described in sufficient detail to enable those skilled in the art to practice the invention. Other embodiments may be utilized and structural, logical, and electrical changes may be made without departing from the scope of the invention. The various embodiments are not necessarily mutually exclusive, as some embodiments can be combined with one or more other embodiments to form new embodiments.

As used herein, "width" may be the width of any shaped structure, including round wires. Thus, "diameter" may be substituted with "width".

As used herein, "head portion" will be understood to mean the portion of an electrode that raised features are attached to or formed into for the purposes of increasing emissivity of an electrode.

Raised features include, but are not limited to, coils, groove structures, formations formed from etching, and/or a round, oval, or polygon-shaped wire or plurality of wires.

Figure 3:
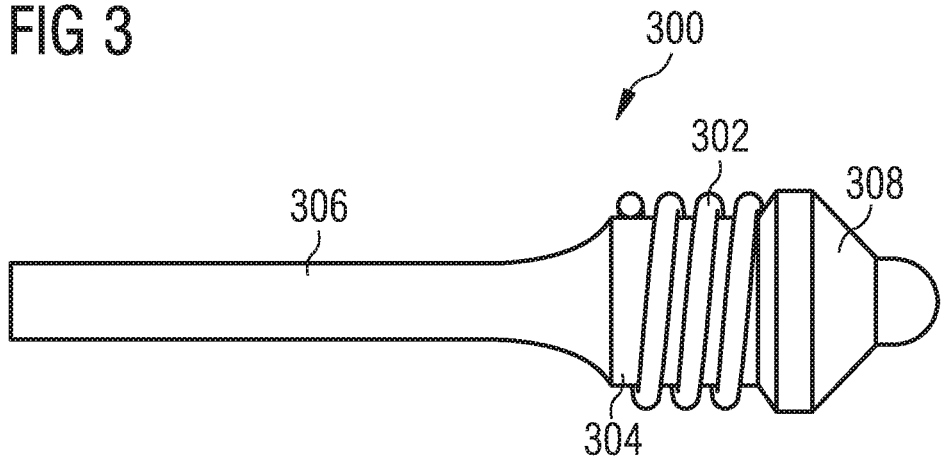
FIG. 3 shows an electrode structure according to an embodiment.

FIG. 3 shows an electrode structure according to an embodiment. Electrode 300 includes single-layer coil 302 wound around electrode head portion 304. Electrode head portion 304 is adjacent to electrode shaft portion 306.

In some embodiments, coil 302 may be formed from tungsten wire. The emissivity of the electrode is increased by winding coil 302 at an optimized pitch around electrode head portion 304. This increases the natural emissivity of electrode 300 by a factor of 65% above a flat surface and by 20% above a tightly wound coil (e.g., coil 202 of FIG. 2). In some embodiments, the coil diameter or width of coil 302 is manufactured as small as possible in order to increase the heat conduction form the heat's origin at front portion 308 to the high emissive area of coil 302. In some embodiments, a maximum preferred coil diameter is 0.2 mm.

The optimal pitch found in Finite Element Method simulations was about 140%, although other optimal pitches may be found depending on the coil material's emissivity. In general, significant improvements were found within a pitch range of $$([(1.35 \mp 0.15) \times \text{Wire Width}]/\text{Wire Width}) \times 100.$$

As used herein the "pitch" is defined as the distance between two raised features (e.g., wire center to wire center) divided by the width of the raised features, expressed as a percentage. Thus, a pitch of 100% indicates that adjacent raised features are touching and a pitch of 200% indicates that consecutive raised features are spaced apart a distance equal to the width of the raised feature.

The term "average pitch" will be understood to mean the sum of the distances between consecutive raised features divided by the number of pairs of raised features. For example, a coil wrapped around an electrode head portion three times will have two distances to sum and two pairs of raised features. Average pitch may also be calculated using other methods such as the median or mode.

Figure 4:
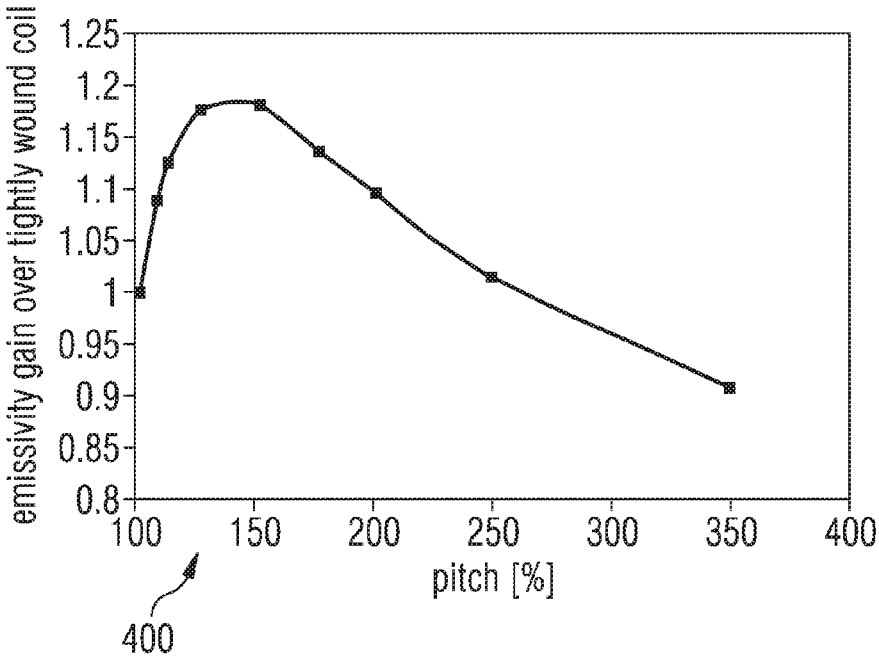
FIG. 4 is a graph showing the emissivity gain of electrode structures according to embodiments over a conventional electrode structure.

FIG. 4 is a graph showing the emissivity gain of electrode structures according to embodiments over a conventional electrode structure. As seen from graph 400, the spacing of coils leads to a significantly reduced electrode temperature compared to a tightly-wound coil design. As the pitch increases beyond 140-150%, however, the emissivity gain begins to diminish. In a tungsten electrode embodiment for ultra-high pressure lamps that included a pitch of 130%, the operating temperature on the front area was reduced by 50° K compared to a tight winding electrode structure. The lower temperature resulted in a 50% reduced evaporation rate over a tight winding electrode structure.

Figure 1:
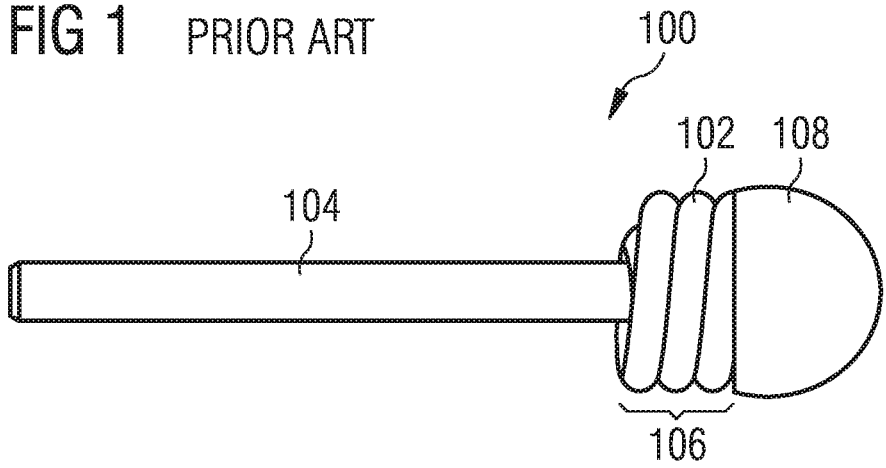
FIG 1 PRIOR ART
FIG. 1 shows a conventional electrode structure for use in a ultra-high-pressure mercury lamp.
Figure 2:
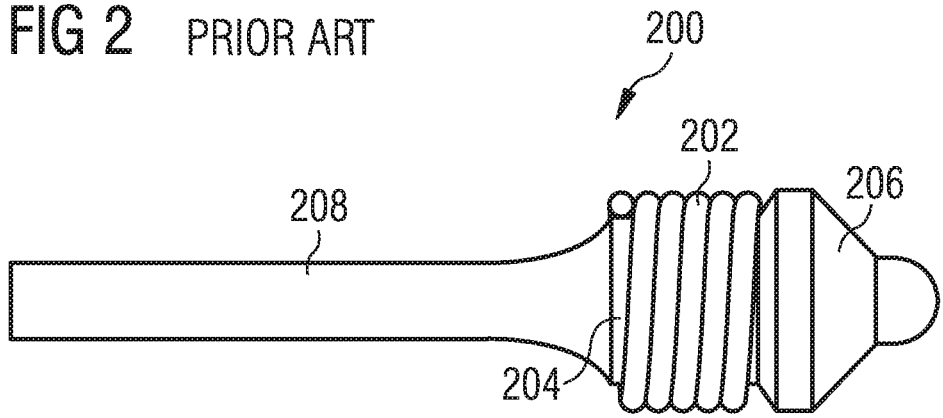
FIG 2 PRIOR ART
FIG. 2 shows another conventional electrode structure for use in a ultra-high-pressure mercury lamp.
Figure 5:
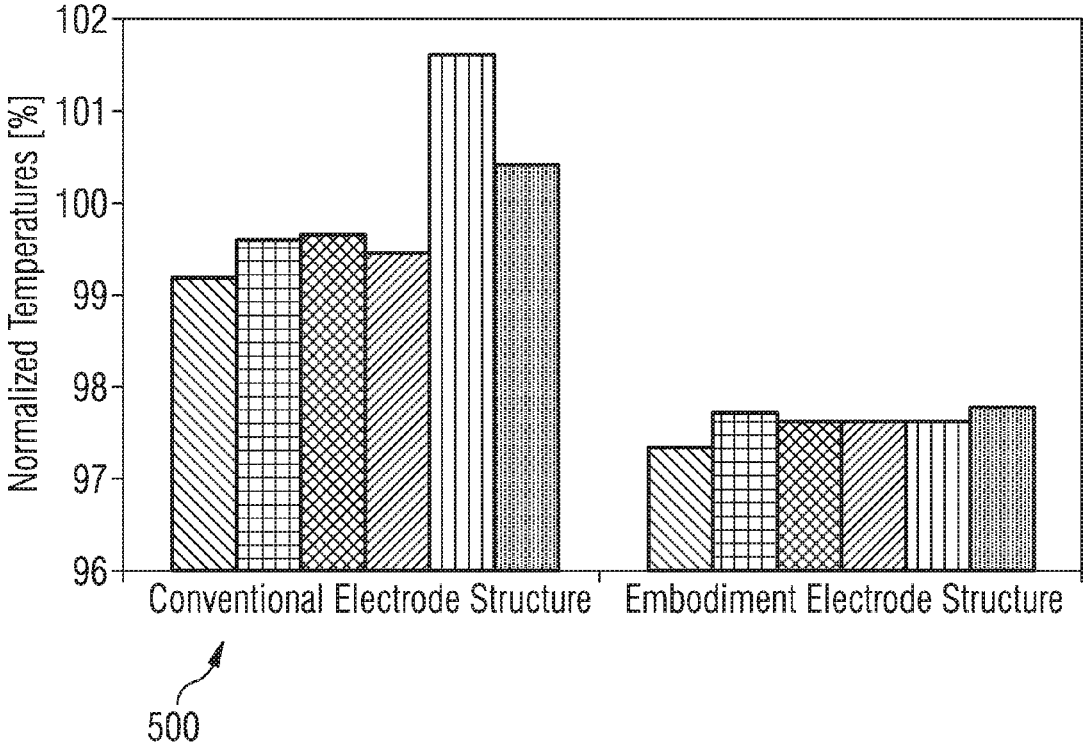
FIG. 5 is a bar graph showing electrode operating temperature measurements of a conventional electrode structure and an electrode structure according to an embodiment.

FIG. 5 is a bar graph showing electrode operating temperature measurements of a conventional electrode structure according to electrode 200 of FIG. 2 and an electrode structure according electrode 300, with coil 302 wound at a pitch of 130%.

Ultra-high pressure mercury lamp test samples were produced with a conventional electrode structure as a first electrode and an embodiment electrode structure as second electrode in the same burner to ensure that both electrodes were operated under identical conditions.

Six lamps were investigated. Each of the lamps are designated in graph 500 by unique hatching patterns, wherein the hatching patterns match for the two electrodes in each lamp. The temperatures on the electrode surface were measured with IR pyrometry, excluding areas on the electrode where the IR signal is superposed by plasma radiation.

Graph 500 shows the electrode temperatures normalized to the average operating temperature of the conventional coil electrodes. The average operating temperature of the embodiment coils were reduced by more than 2%. Because the tungsten evaporation rate is exponentially related to temperature, the tungsten evaporation rate is halved with an average temperature reduction of approximately 2%.

Thus lamps with an electrode structure according to an embodiment, will last longer at a given temperature or can be operated at higher temperatures over conventional electrode structures. Moreover, manufacturing electrode structures according to an embodiment will typically entail inexpensive modifications to existing electrode manufacturing equipment.

Figure 6:
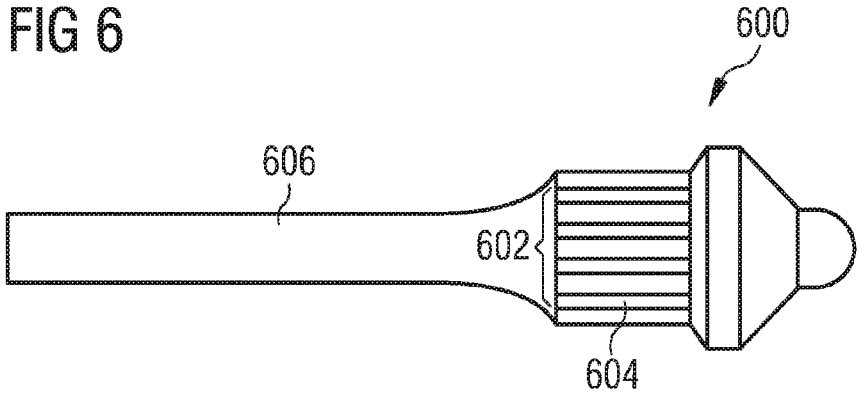
FIG. 6 shows an alternative electrode structure according to an embodiment.

FIG. 6 shows an alternative electrode structure according to an embodiment. Electrode 600 includes plurality of wires 602 attached to electrode head portion 604 in axial sections. Electrode head portion 604 is adjacent to electrode shaft portion 606.

Plurality of wires 602, if made of tungsten, is expected to have properties similar to coil 302 of FIG. 3, and thus the optimized pitch of plurality of wires 602 would be around 140% with a groove width of approximately 0.2 mm.

Figure 7:
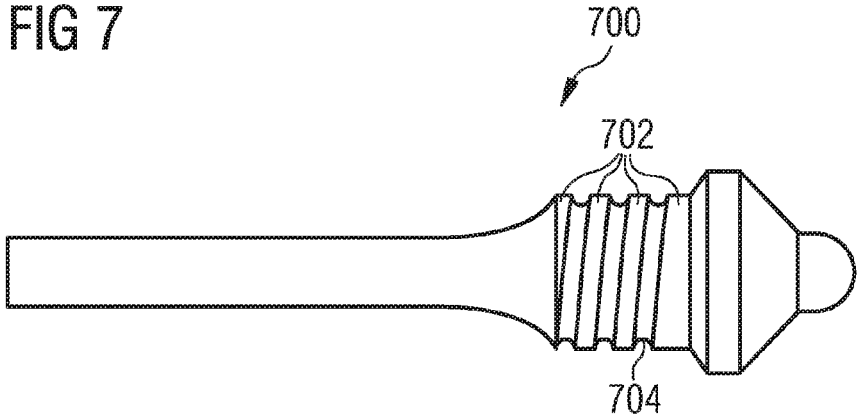
FIG. 7 shows an alternative electrode structure according to an embodiment.

FIG. 7 shows an alternative electrode structure according to an embodiment. Electrode 700 includes raised groove features 702 formed as a result of grooving, carving, or etching electrode head portion 704. Groove features 702, if electrode head 204 is made of tungsten, is expected to have properties similar to coil 302 of FIG. 3, and thus the optimized pitch of groove structure 702 would be around 140% with a groove width of approximately 0.2 mm.

It will be understood that the electrode structures shown in FIGS. 3, 6, and 7 are only three possible electrode structures, and many more are within embodiments of the invention. For example, wire applied in a coil, as shown in FIG. 3, could also be applied in concentric sections. Similarly, groove structure 702 of FIG. 7 could also take the form of circumferential slots machined by micro-machining techniques at an optimized pitch, depth, and width. The slots could be applied near the tip and/or elsewhere. Other machined shape variations may include cork screw slots, axial slots, or hole patters.

Figure 8:
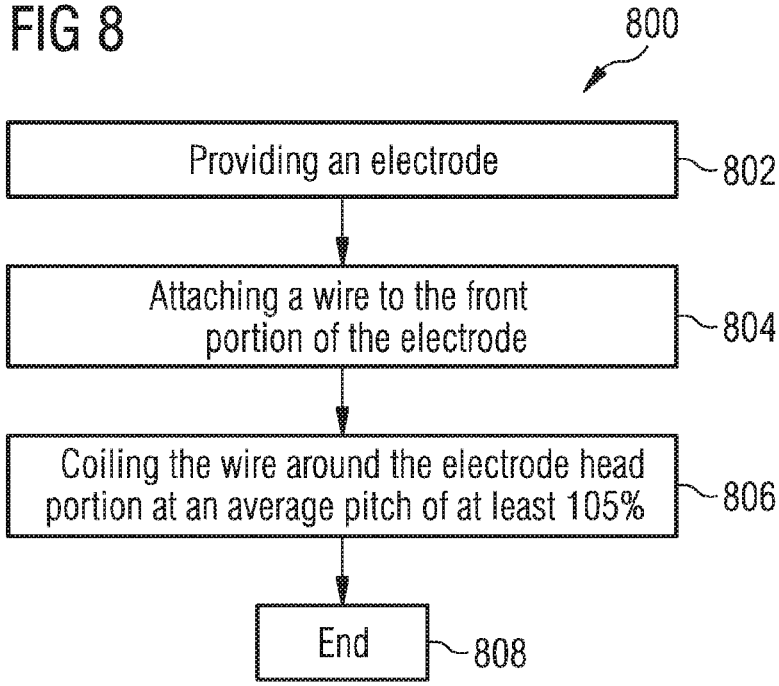
FIG. 8 is a flow chart for a method of manufacturing an electrode structure according to an embodiment.

FIG. 8 is a flow chart for a method of manufacturing an electrode structure within an embodiment. At 802, an electrode is provided. At 804, a wire is attached to the front portion of the electrode. At 806, the wire is coiled around the electrode head portion at an average pitch of at least 105%. At 808, method 800 ends.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. An electrode structure configured to operate in a discharge lamp, the electrode structure comprising:

a shaft;

an electrode head portion attached to the shaft, wherein the electrode head portion is larger in diameter than the shaft; and a coil, wherein the coil is wrapped onto the electrode head portion at an average pitch between 124% and 151%.

2. The electrode structure of claim 1, wherein the coil comprises a tungsten wire, the tungsten wire having a width equal or less than 0.2 millimeters.

3. The electrode structure of claim 1, wherein the coil comprises tungsten wire.

4. An electrode structure configured to operate in a discharge lamp, the electrode structure comprising:

a shaft;

an electrode head portion attached to the shaft, wherein the electrode head portion is larger in diameter than the shaft, and wherein the electrode head portion comprises a plurality of raised features formed into said head portion, wherein the electrode head portion is arranged in a configuration such that an average pitch of the plurality of raised features between 124% and 151%.

5. The electrode structure of claim 4, wherein the plurality of raised features comprise a plurality of wires.

6. The electrode structure of claim 5, wherein each of the plurality of wires form a concentric circle wrapped around the electrode head portion.

7. The electrode structure of claim 5, wherein each of the plurality of wires form an axial section attached to the electrode head portion.

8. The electrode structure of claim 5, wherein the plurality of wires comprises tungsten and the width of each of the plurality of wires is equal or less than 0.2 millimeters.

9. The electrode structure of claim 4, wherein the plurality of raised features comprise a plurality of grooved features.

10. The electrode structure of claim 9, wherein the plurality of grooved features comprises tungsten and the width of each of the plurality of grooved features is equal or less than 0.2 millimeters.

11. The electrode structure of claim 4, wherein the plurality of raised features comprises tungsten.

12. A discharge lamp comprising two electrode structures, wherein at least one of the two electrode structure comprises:

a shaft;

an electrode head portion attached to the shaft, wherein the electrode head portion is larger in diameter than the shaft; and a coil, wherein the coil is wrapped onto the electrode head portion at an average pitch between 124% and 151%.

13. The discharge lamp of claim 12, wherein the coil comprises a tungsten wire, the tungsten wire having a width equal or less than 0.2 millimeters.

14. The discharge lamp of claim 12, wherein the coil comprises tungsten wire.

15. A method of manufacturing an electrode structure for a discharge lamp, the method comprising:

providing an electrode with an electrode head portion and a shaft portion configured to operate in the discharge lamp;

forming raised features into an electrode head portion of the electrode at an average pitch between 124% and 151% wherein the electrode head portion is larger in diameter than the shaft portion.

* * * * *